US006325678B1

(12) United States Patent
Auclair

(10) Patent No.: US 6,325,678 B1
(45) Date of Patent: Dec. 4, 2001

(54) ELECTRICAL CLAMP CONNECTOR

(75) Inventor: John W. Auclair, Norfolk, CT (US)

(73) Assignee: Electric Motion Company, Inc., Winsted, CT (US)

( * ) Notice: Subject to any disclaimer, the term of this patent is extended or adjusted under 35 U.S.C. 154(b) by 0 days.

(21) Appl. No.: 09/643,977

(22) Filed: Aug. 22, 2000

(51) Int. Cl.[7] ..... H01R 4/30
(52) U.S. Cl. ..... 439/803
(58) Field of Search ..... 439/801, 803, 439/804

(56) References Cited

U.S. PATENT DOCUMENTS 3,380,014 * 4/1968 Schenker et al. ..... 339/97
3,544,956 * 12/1970 Bricker, Jr. ..... 339/264
3,892,455 * 7/1975 Sotolongo ..... 439/100
3,988,052 * 10/1976 Mooney et al. ..... 439/804
4,169,652 * 10/1979 Hockele et al. ..... 439/781
5,152,701 * 10/1992 Polidori ..... 439/791
6,045,414 * 4/2000 DeFrance ..... 439/794
6,174,177 * 1/2001 Auclair ..... 439/100

* cited by examiner

*Primary Examiner*—Gary Paumen
*Assistant Examiner*—Edwin A. León
(74) *Attorney, Agent, or Firm*—Alix, Yale & Ristas, LLP

(57) ABSTRACT

An electrical clamp connector for clamping ground conductors employs interconnecting male and female clamp sections having integrally extending jaws. The male clamp section forms a tongue which is received in a complementary groove defined by the female clamp section. The jaws include V-shaped holding surfaces and a retaining lip which allow the clamping of conductors of various sizes. The clamp sections are fastened together by a bolt passing through the female clamp section to threadably engage the male clamp section whereby the jaws are drawn together, clamping conductors received therein.

17 Claims, 3 Drawing Sheets

ELECTRICAL CLAMP CONNECTOR

BACKGROUND OF THE INVENTION

This invention relates generally to connectors for wire conductors. More particularly, the present invention relates to clamp-type connectors for electrically connecting ground conductors in a communication system.

Connector devices of numerous types and configurations have been advanced for receiving and securing the ground conductors for communication systems. For example, U.S. Pat. No. 3,426,319 discloses a neutral wire connector for electrically connecting a plurality of aluminum or copper wires. The device employs a plurality of wire receiving and screw receiving openings selectively dimensioned and shaped for receiving wires of various dimensions to secure the wires in place.

SUMMARY OF THE INVENTION

Briefly stated, the invention in a preferred form is an electrical clamp connector which clamps at least two conductors between the concave holding surfaces of opposed jaws. The electrical clamp connector comprises interconnecting male and female clamp sections fastened together by a bolt, each section including an integrally extending jaw. The male clamp section has a body which forms a tongue and is traversed by a threaded axial bore. The female clamp section has a body which defines a complementary groove and includes an opening sized to receive the fastening bolt. The exterior surface of the female clamp section body is rounded to facilitate installation and access in regions of limited headroom. A preferred embodiment of the electrical clamp connector is formed when the male clamp section tongue is received in the female clamp section groove with the bolt passing through the opening in the female clamp section to engage the threaded bore in the male clamp section.

The clamp jaws extend transversely to the bodies of the clamp sections and each jaw preferably includes a V-shaped concave holding surface. The male clamp section jaw includes a retaining lip which extends toward the female clamp section jaw parallel and in spaced relationship to the clamp section bodies. The retaining lip serves to partially enclose the space between the jaws. The jaws have a length measured along their holding surfaces which is greater than the diameter of the rounded female clamp section body.

An electrical clamp connector according to the present invention can accommodate conductors of various sizes and shapes. A reliable electrical connection is formed by tightening the fastening bolt which draws the opposed jaws together around conductors received therein. The convergent V-shape of the concave holding surfaces forms a positive electrical contact with various sizes and shapes of conductors while centering and retaining the conductors between the jaws. The retaining lip further retains the conductors and forces them into a tightly clamped, electrically conductive relationship between the jaws.

An object of the present invention is to provide a new and improved electrical clamp connector having an efficient and cost effective construction.

Another object of the invention is to provide a new and improved electrical clamp connector having a minimum of movable parts which can be efficiently installed to clamp electrical conductors.

A further object of the invention is to provide a new and improved electrical clamp connector suitable for clamping conductors of various sizes and shapes.

Other objects and advantages of the invention will become apparent from the drawings and the specification.

DETAILED DESCRIPTION OF THE PREFERRED EMBODIMENT

Figure 1:
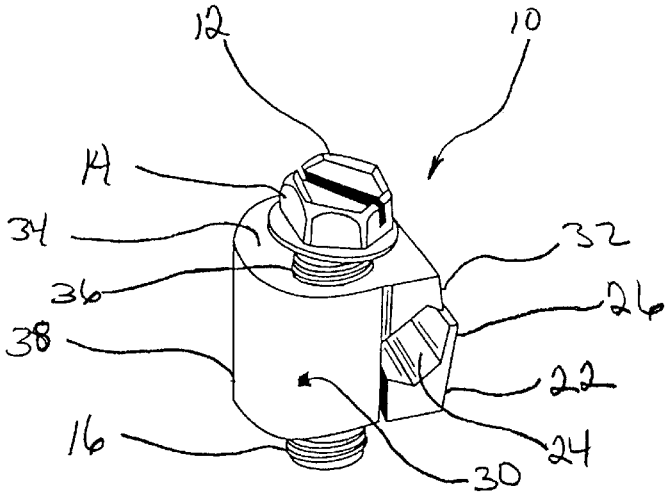
FIG. 1 is a side perspective view of an electrical clamp connector in accordance with the present invention.

With reference to the drawings wherein like numerals like parts throughout the several Figures, an electrical clamp connector in accordance with the present invention is generally designated by the numeral 10. Electrical clamp connector 10 is especially adapted to function as a connector for clamping ground conductors of various sizes and shapes. In this regard, the electrical clamp connector is preferably formed from copper, brass, bronze or other metal components which have a high conductivity.

As illustrated in FIGS. 1–6 and 8, the electrical clamp connector 10 is preferably assembled from three components: a bolt 12, a male clamp section 20, and a female clamp section 30. The bolt 12 includes a radially enlarged driving head 14 and an axially extending threaded shank 16. The male clamp section 20 includes an axially extending body 21 having a cylindrical portion defining a tongue 28 (best seen in FIG. 6). The body of the male clamp section is traversed by a threaded axial bore 18 configured to receive and threadably engage the shank 16 of the bolt 12.

A jaw 22 integrally projects from one end of the male clamp section 20. The jaw extends transversely from the male clamp section body 21 and includes a concave holding surface 24 having an orientation perpendicular to the axial bore 18. The jaw 22 includes a retaining lip 26 extending away from the jaw 22 parallel and in spaced relationship to the axial bore 18. Between the retaining lip 26 and the male clamp section body, the jaw 22 takes the form of a preferably convergent V-shaped concave holding surface 24. The jaw 22 has a lateral extent, traversed by the retaining lip 26 and the holding surface 24, substantially greater than the diameter of the tongue 28 formed by the male clamp section body 21.

The female clamp section 30 includes a body 31 having an axially extending rounded exterior surface 38. The rounded configuration of the female clamp section body 31 facilitates access to and maneuverability of the electrical clamp connector 10 during installation in spaces which typically have extremely limited headroom. The rounded configuration also eliminates several sharp corners and edges which can damage adjacent cables or equipment. A rounded body shape also serves to reduce material costs by reducing the amount of material used for each connector.

Figure 6:
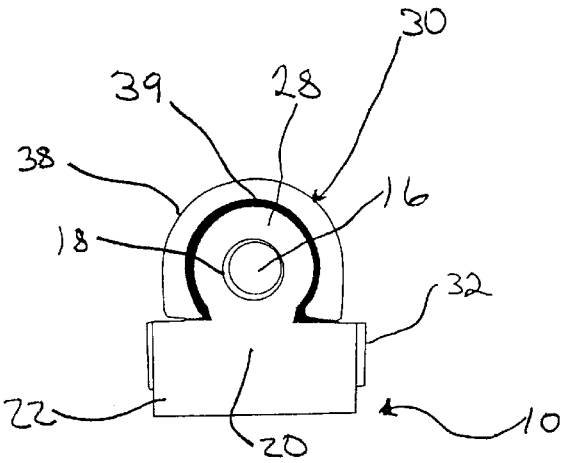
FIG. 6 is a bottom plan view of the electrical clamp connector of FIG. 4.

As best illustrated in FIG. 6, the female clamp section body 31 surrounds and defines a groove 39 having a shape that is complementary to the tongue 28 formed by the male clamp section body 21. A jaw 32 integrally extends from the first end 34 of the female clamp section body 31. The first end 34 also includes an axial opening 36 sized to receive the shank 16 of the bolt 12. The female clamp section jaw 32 has an orientation and configuration that is cooperative with the male clamp section jaw 22. The female clamp section jaw 32 extends transversely from the female clamp section body and includes a concave holding surface 24, preferably having a V-shaped configuration similar to the holding surface 24 of the male clamp section jaw 22. The female clamp section jaw 32 preferably does not include a retaining lip.

Figure 2:
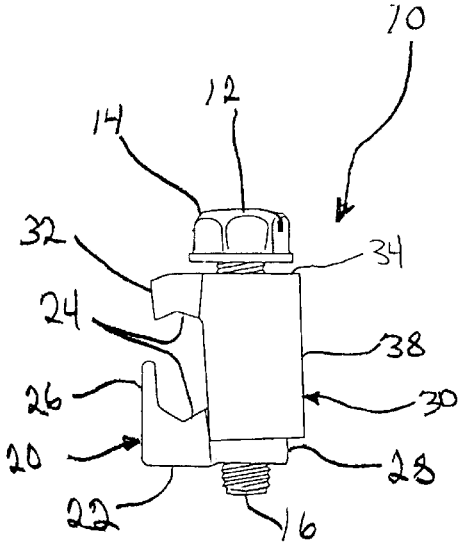
FIG. 2 is a side elevational view of the electrical clamp connector of FIG. 1, viewed from generally the opposite side thereof.
Figure 3:
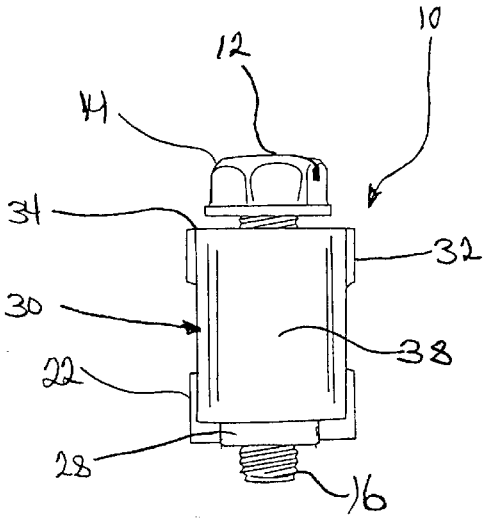
FIG. 3 is a rear elevational view of the electrical clamp connector of FIG. 1.
Figure 4:
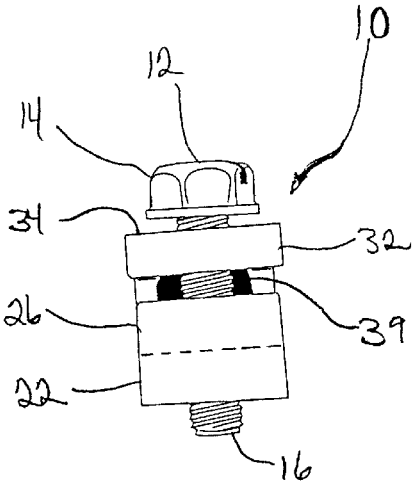
FIG. 4 is a front elevational view of the electrical clamp connector of FIG. 1.
Figure 5:
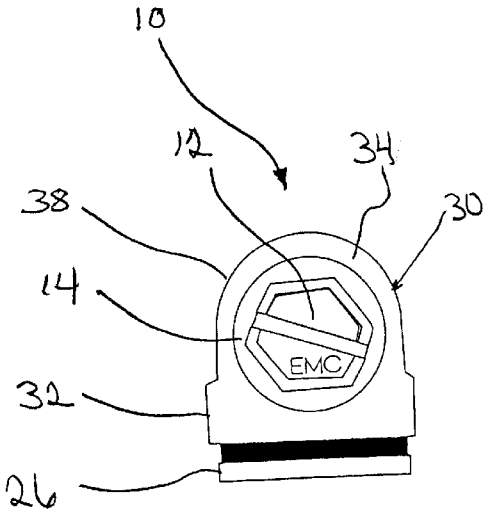
FIG. 5 is a top plan view of the electrical clamp connector of FIG. 4.

The component parts of the electrical clamp connector 10 are assembled by passing the shank 16 of the screw 12 through the axial opening 36 in the first end 34 of the female clamp section. The tongue 28 of the male clamp section 20 is received in the groove 39 defined by the female clamp section body 31. The male clamp section is oriented so that the axially extending body 21 of the male clamp section 20 extends toward the first end 34 of the female clamp section 30. In this orientation the concave holding surface 24 of the male clamp section jaw 22 will face and be substantially aligned with the concave holding surface 24 of the female clamp section jaw 32. The bolt 12 is then threadably engaged in the axial bore 18 in the male clamp section body 21. As the bolt 12 is threaded into the bore 18, the male clamp section body 21 is drawn into the female clamp section body 31 and the male clamp section jaw 22 is drawn toward the female clamp section jaw 32. As the jaws 22, 32 are drawn together, the retaining lip 26 of the male clamp section jaw 22 is configured to pass outside of the female clamp section jaw 32. This relationship is best illustrated in FIG. 2.

Figure 7:
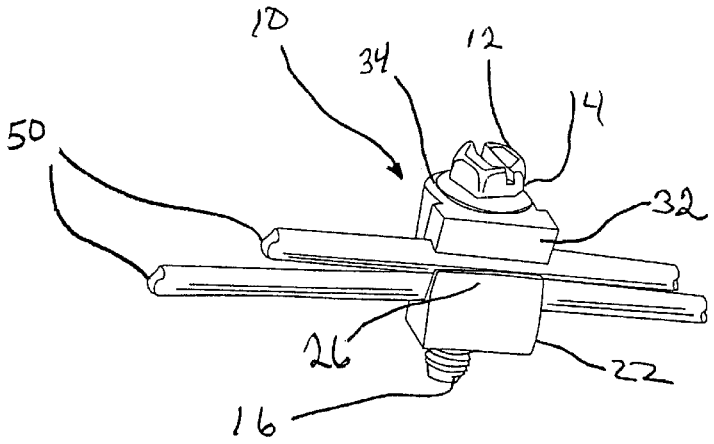
FIG. 7 is a frontal perspective view of the electrical clamp connector of FIG. 1 in an installed configuration clamping two electrical conductors (partially illustrated)
Figure 8:
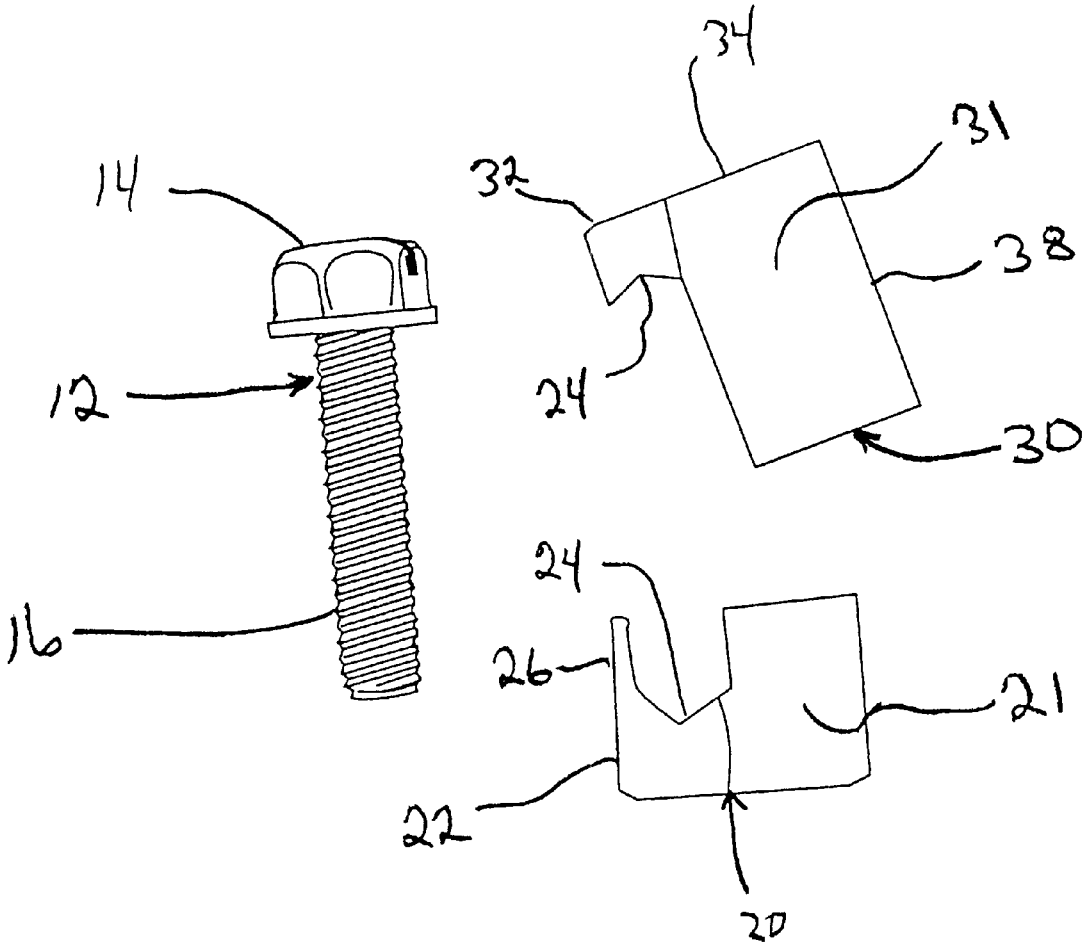
FIG. 8 is an exploded view of the electrical clamp connector of FIG. 1.

The convergent V-shaped holding surfaces 24 exert centering forces on rounded conductors placed between the jaws 22, 32 of the electrical clamp connector 10. The jaws 22, 32 are of substantially the same lateral extent as measured along their respective holding surfaces 24. Both jaws 22, 32 have a lateral extent slightly greater than the diameter of the rounded exterior surface 38 of the female clamp section 30. The jaws 32, 22 are dimensioned and configured to provide an extended clamping surface to increase the stability of the electrical clamp connector 10 when it is in an installed configuration, as illustrated in FIG. 7. The V-shaped holding surfaces 24 exert a self-centering force on the typically rounded conductors 50 while the retaining lip 26 of the male clamp section jaw 22 serves to partially enclose the area between the jaws 22, 32, further enhancing the retention of the conductors 50 between the jaws.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An electrical clamp connector comprising:

a male clamp section including an axially extending body having a cylindrical surface portion defining a tongue, said cylindrical surface portion substantially symmetric about an axis defined by a threaded axial bore traversing said body and an integral jaw transversely projecting from one end of said body;

a female clamp section body having an axially extending rounded exterior surface substantially symmetric about said axis and defining a groove complementary with said tongue, said female clamp section including a first end having an opening coaxial with said groove and an integral transversely projecting jaw; and a bolt having a radially enlarged driving head and a threaded shank axially extending from the head;

wherein said tongue is receivable in said groove and said bolt threaded shank is receivable through said first end opening and threadably engageable in said male clamp section for securing said jaw members in clamped relationship.

2. The connector of claim 1, wherein said male clamp section jaw includes a concave holding surface, and said female clamp section jaw includes a concave holding surface, said holding surfaces facing each other and substantially aligned upon reception of said tongue in said groove.

3. The connector of claim 2, wherein said holding surfaces are V-shaped.

4. The connector of claim 2, wherein said male clamp section jaw includes a retaining lip integrally extending parallel to said axial bore and in spaced relationship to said body, thereby partially defining said male clamp section jaw holding surface.

5. The connector of claim 2, wherein said jaws are of substantially equivalent lateral extent and said lateral extent is greater than the diameter of said female clamp section body.

6. An electrical clamp connector and conductor assembly comprising:

an electrical clamp connector including a bolt having a radially enlarged driving head and a threaded shank axially extending from the head, a male clamp section including a first body having a cylindrical surface portion defining a tongue, said first body traversed by a threaded axial bore and including a first jaw projecting from one end of said first body and a female clamp section including a second body having a rounded exterior surface and defining a groove complementary with said tongue, said second body including a first end having a projecting second jaw and an axial opening sized to receive said shank; and two electrical conductors;

wherein said tongue is received in said groove and said shank is received through said second body first end opening and threadably engaged in said axial bore and said conductors are received between said first and second jaws and said bolt head is engaged against said second body first end, whereby said first and second jaw members secure said conductors in clamped relationship.

7. The electrical clamp connector and conductor assembly of claim 6, wherein said first jaw includes a retaining lip integrally extending parallel to said axial bore and in spaced relationship to said first body, thereby partially defining said first jaw holding surface.

8. The connector of claim 6, wherein said axial bore defines an axis, said tongue being substantially symmetric about said axis, and said second body is substantially symmetric about said tongue.

9. The electrical clamp connector and conductor assembly of claim 6, wherein said first and second jaws are of substantially equivalent lateral extent and said lateral extent is greater than the diameter of said second body rounded exterior surface.

10. The electrical clamp connector and conductor assembly of claim 6, wherein said first and second jaws each include a concave holding surface, said holding surfaces facing each other and substantially aligned upon reception of said tongue in said groove.

11. The electrical clamp connector and conductor assembly of claim 10, wherein said holding surfaces are V-shaped.

12. An electrical clamp connector comprising:

male clamp means for engaging a first conductor, said male clamp means including tongue means for defining a tongue and integrally extending first jaw means for grasping said first conductor, said tongue means comprising a generally cylindrical body that defines a threaded axial bore;

female clamp means for engaging a second conductor, said female clamp means cooperative with said male clamp means and including an axially extending body with a rounded exterior surface and integrally extending second jaw means for grasping said second conductor, said female clamp means having groove means for defining a groove configured to receive said cylindrical body; and clamp securement means for securing said male clamp means and said female clamp means in clamped relationship;

wherein said tongue means and said groove means interlock and said male clamp means and said female clamp means are securable by said securement means passing through said female clamp means to threadably engage said threaded axial bore whereby said first and second conductors are fixable in clamped relationship between said first and second jaw means.

13. The connector of claim 12, wherein said first jaw means further comprises retaining means for retaining said first and second conductors between said first and second jaw means.

14. The connector of claim 12, wherein said first and second jaw means are of substantially equivalent lateral extent and said lateral extent is greater than the diameter of the rounded exterior surface of said female clamp means axially extending body.

15. The connector of claim 12, wherein said male clamp means is traversed by said threaded axial bore, said cylindrical body being substantially symmetric about said threaded axial bore, and said rounded exterior surface is substantially symmetric about said threaded axial bore.

16. The connector of claim 12, wherein said first and second jaw means each further comprise a concave holding surface.

17. The connector of claim 16, wherein each said concave holding surface is V-shaped.

* * * * *